United States Patent [19]

Eddy

[11] Patent Number: 5,064,197

[45] Date of Patent: Nov. 12, 1991

[54] METHOD AND MEANS TO ADJUST SOUND CHARACTERISTICS OF CLUB HEAD UPON IMPACT WITH GOLF BALL

[76] Inventor: Laurence D. Eddy, 4414 Terreno Ct., San Diego, Calif. 92124

[21] Appl. No.: 682,128

[22] Filed: Apr. 8, 1991

[51] Int. Cl.[5] ..... A63B 53/04

[52] U.S. Cl. ..... 273/167 H; 273/78; 273/173

[58] Field of Search ..... 273/162 R, 167 R, 167 F, 273/167 H, 78, 171, 173, 174

[56] References Cited

U.S. PATENT DOCUMENTS

| | | | |
|---|---|---|---|
| 777,400 | 12/1904 | Clark | 273/78 |
| 1,359,220 | 11/1920 | Beamer | 273/78 |
| 3,218,072 | 11/1965 | Burr | 273/167 H |
| 3,387,844 | 6/1968 | Shippee | 273/167 H X |
| 3,888,492 | 6/1975 | Cabot | 273/173 X |
| 4,113,249 | 9/1978 | Beery | 273/78 |
| 4,252,262 | 2/1981 | Igarashi | 228/174 |
| 4,429,879 | 2/1984 | Schmidt | 273/167 H |
| 4,630,826 | 7/1984 | Nishigaki | 273/167 |
| 4,749,197 | 6/1988 | Orlowski | 273/173 |
| 4,812,187 | 3/1989 | Honma | 156/245 |
| 4,930,781 | 6/1990 | Allen | 273/167 F |
| 4,944,515 | 7/1990 | Shearer | 273/167 H |

*Primary Examiner*—William H. Grieb

*Attorney, Agent, or Firm*—Duane C. Bowen

[57] ABSTRACT

Method and means to change the sound emitted from a metal "wood" golf club head by providing a first foward chamber in the head opening to the club head face, by providing a resilient face plate covering the first forward chamber and vibrating at a given primary frequency upon impact with a golf ball, and by providing a second rear chamber in the head disposed rearwardly of the first chamber and connected thereto by a throat whereby the second chamber and the throat have the function of a Helmholtz resonator modifying the sound propagated in the first forward chamber upon impact with a golf ball. The first and second chambers can be filled by a gas (such as air), a liquid, or a solid.

11 Claims, 1 Drawing Sheet

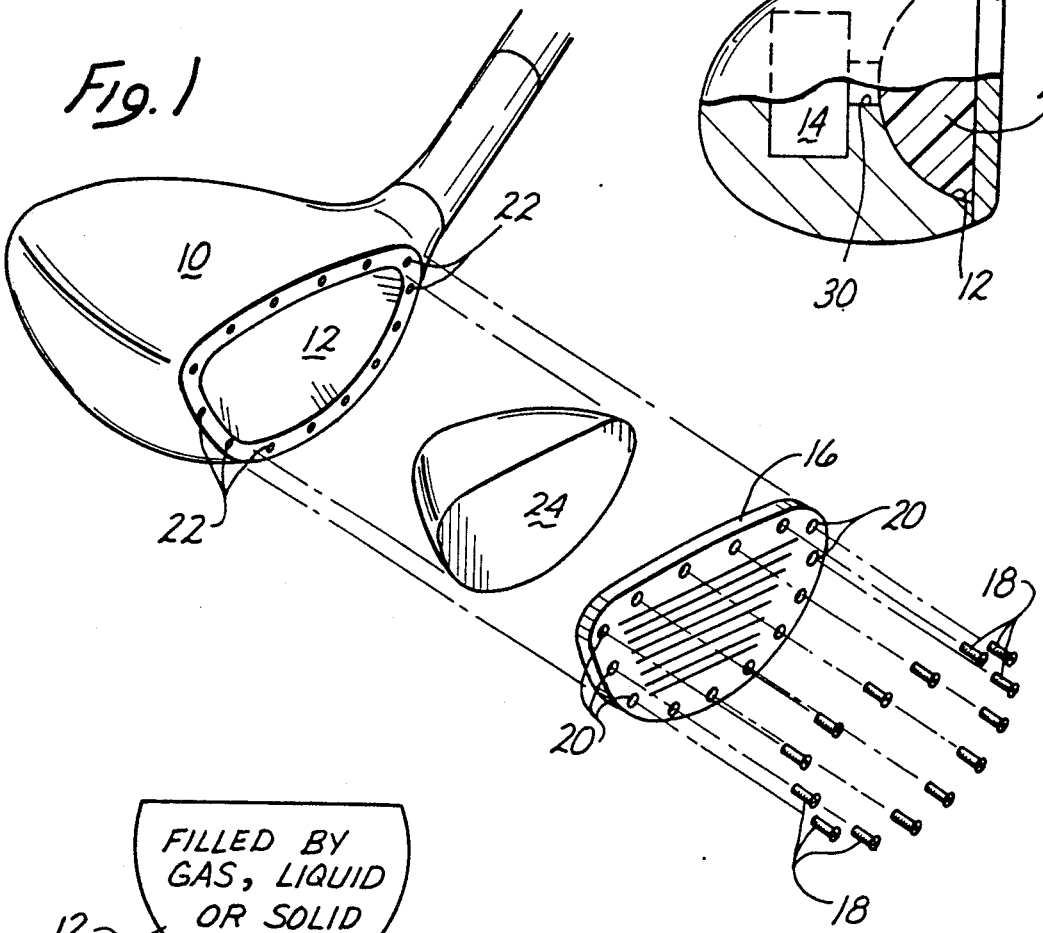
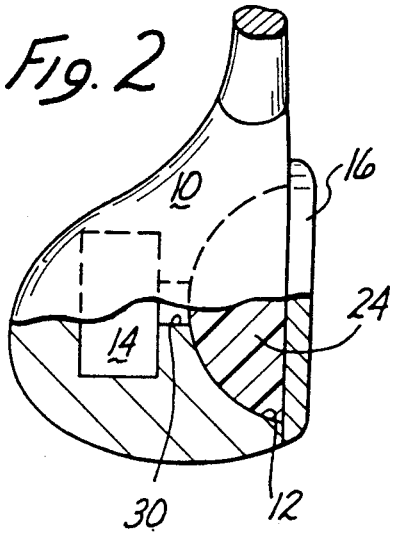
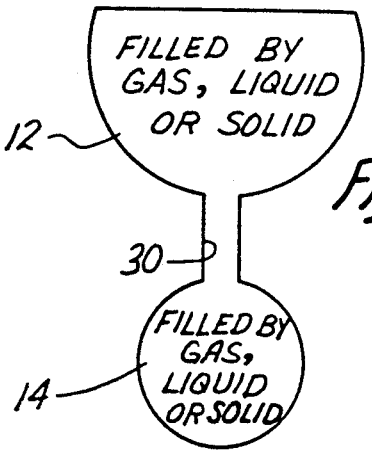
Fig. 3
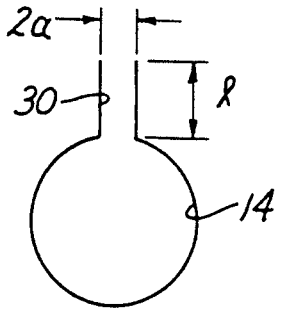
Fig. 4

METHOD AND MEANS TO ADJUST SOUND CHARACTERISTICS OF CLUB HEAD UPON IMPACT WITH GOLF BALL

BRIEF SUMMARY OF THE INVENTION

BACKGROUND AND OBJECTIVES

My invention relates to means and method improvements in the head of a golf club classified as a "wood" and having a resilient face plate. The improvement results in controlling the sound emitted from the club head upon golf ball impact with the face plate. The result is achieved partly by providing a chamber in the club head having the function of a Helmholtz resonator.

Previously known is use of a separate face plate on a golf club attached to a club head by screws or other means and an intended function of changing the interaction between the face of the club and a golf ball upon impact, i.e., U.S. Pat. No. 4,749,197, issued June 7, 1988, to David C. Orlowski. Also previously known is a metal club head and a cavity in a club head, also seen in the Orlowski patent. All of these factors (separate face plate, metal head, and head cavity) change the sound characteristics of a club head upon impact with a golf ball. Some sounds upon impact are more pleasant to the human ear than others. Metal clubs may make pinging, pincking or plincking sounds when striking golf balls. The ideal sound to many is the resounding thud that a wooden driver makes when struck on its sweet spot. It is an objective of my invention to provide metal or other non-wooden drivers with improved impact sounds upon striking golf balls similar to the sound of a well hit stroke with a driver made of wood.

Additional objectives include providing a first forward chamber in the club head covered by a face plate and a second rear chamber connected to the first chamber by a throat; devising the rear chamber in the club head as a Helmholtz resonator; modifying sounds produced in the chambers by use of air-filled, liquid-filled and/or solid-filled chambers; and to provide metal or the like "wood" heads with the above and other features and characteristics.

Further objective of my invention are to:

(a) maximize the flying distance of the ball, (b) take advantage of state-of-the art aluminum alloys for face plate fabrication, (c) suppress the metal pinging sound produced when a metal driver or the like strikes a golf ball, and (d) facilitate the production processes by using aerospace adhesives for improved strength and reduced production cost.

The unique features described hereafter enable a club head to be tailored to provide both enhanced driving performance and attenuation of harsh and unpleasant sounds produced when a non-wood driver or the like strikes a golf ball. Materials and cavity designs are varied to optimize the playing characteristics expected by today's discriminating golfers. The sound emitted by the club head can be reduced in amplitude and modified in pitch through the use of an integral Helmholtz resonator.

My invention will be best understood, together with additional objectives and advantages thereof, from the following description, read with reference to the drawings, in which:

THE DRAWINGS

FIG. 1 is a perspective view, in exploded form, of a club head forming a specific embodiment of my invention.

FIG. 2 is a top view of the club head with portions broken away to better reveal interior structure.

FIG. 3 is a schematical view analytically illustrating the relationship between forward and rear chambers in the club head.

FIG. 4 is a schematical view of the classical shape of a Helmholtz resonator.

SPECIFIC DESCRIPTION

When the words "wood" or "woods" are used in this specification and in the claims in classifying a golf club head, they mean what has been traditionally known as "wood" or "woods" in golfing, namely the driver, brassie, spoon, etc., that were made of wood for many years, whereas the remainder of the clubs, the "irons", were made of metal, i.e., clubs "1" to "9". In present days, "woods" quite often are made of metal and quite often are hollow. The club heads of my invention have two chambers or cavities and wooden material would be inappropriate because of lack of weight and strength due to the cavities. Such "woods" may be made of composite materials, i.e., plastic that is filled with fibers of carbon, glass, graphite, boron, etc., and I mean to include those composite materials, as well as metals, when I use the expressions "wood" or "woods".

From FIGS. 1 and 2, it will be observed that club head 10 has a forward chamber or cavity 12 and a rear chamber 14. Forward chamber 12 is covered with a plate 16 that preferably is formed of metal, although it could be formed of the above-described composite materials. Plate 16 is suitably secured in place, such as by screws 18 extending through openings 20 in plate 16 and into openings 22 in club head 10. Bonding plate 16 in place by an aerospace quality adhesive may improve strength and reduce production costs. If plate 16 is formed of metal, the material can be selected from state-of-the-art aluminum or steel alloys, especially those in use in the aerospace industry.

Chambers 12, 14 preferably will be filled with air but can be optionally filled with a liquid or a solid such as a plastic foam, as indicated by the legends in FIG. 3. If a liquid were to be used, a membrane (not shown) would be needed to keep the liquid in the correct chamber unless both chambers contained the same liquid. Depending on what fills chamber 12, 14, sound in the chambers, upon impact of face plate 16 with a golf ball, will attenuate. FIGS. 1 and 2 illustrate filling of forward chamber 12 with a plastic member 24 either molded to shape and then bonded in place, or poured in place, in which latter case a membrane (not shown) would have to be used to prevent the plastic from entering the opening or throat 30 to second chamber 14. Plastic member 24 could be made of polyurethane foam, for example.

It will be recognized that when plate 16 is struck by a golf ball, it will vibrate at a specific primary frequency which, by itself, would produce a certain sound pitch. I prefer to forge, draw or extrude plate 16 out of an advanced or aerospace quality aluminum alloy for durability. Depending on the type of material used for plate 16, i.e., an aluminum alloy, a steel or another metal or alloy, and depending on the breadth, thickness and heat treatment of the plate alloy, the pitch will vary. An example of a change in the shape of plate 16 would be if it were made thinner, at least in its central portion (by a cavity in its back, not shown). In that case, not only would the pitch be changed but also a trampoline-like effect induced when plate 16 is struck by a golf ball, thereby enhancing the propulsive effect on the golf ball upon impact. Some advanced metal materials will particularly resist dimpling by impacts with golf balls. An insert 24 may support face plate 16 to resist dimpling and to influence resiliency of plate 16.

The 7000-series high strength aerospace aluminum alloys (heat-treatable zinc-magnesium-aluminum) such as 7178, 7001 or 7046 can be used for plate 16. These can be formed by casting, forging, drawing or extruding. Another alloy to be considered, specifically configured for sporting goods, is CU31, a high-strength, tough version of 7050 created by Alcoa (Pittsburgh). Another aluminum alloy that can be used is called EA70 and was codeveloped by Alcoa and Easton. Kobe Steel Company of Japan also has a good alloy named MZ74 which is a 7482 aluminum alloy.

The relationship of cavity 14 and throat 30 to sound in chamber 12 is basically that of a Helmholtz resonator. Cavity 12 may or may not have a half-round shape and cavity 14 may or may not have a round shape. More likely, to fit the envelope of a more or less normal wood club head shape, cavity 14 will not be fully rounded, if rounded at all. In FIG. 2, chamber 14 may be taken to be either of right rectangular shape or cylindrical shape. Multiple openings or throats 30 could be used between cavities 12 and 14, although one throat 30 is more likely.

From the viewpoint of acoustics, chamber 14 and throat or opening 30 can be considered to be a Helmholtz resonator relative to sound coming from cavity 12. Referring to FIG. 4, basic factors involving the effect of the resonator include:

(a) the area of the throat 30, which if cylindrical would have a diameter of "2*a*" (two times radius "a"), (b) the length "b" of throat 30, and (c) the volume of cavity 14.

The book *Fundamentals of Acoustics*, by Kinsler and Frey, Second Edition (John Wiley & Sons), has an illustration like FIG. 4, in its FIG. 8.1, on page 186. The acoustical effect of the basic configuration depends on the cross-sectional area of the opening 30 and the effective length "b" (page 187), the amplitude "p" of the sound wave impinging on the resonator opening and the driving force "f" (page 188), and the enclosed volume 14 "v" (page 191). At page 194, it is stated:

> "In deriving the equation for the resonant frequency of a Helmholtz resonator, no assumption has been given which restricts its shape to that of a sphere. For a given opening, it is the volume of the cavity, and not its shape, that is important."

In more sophisticated applications of Helmholtz resonators other factors such as wave lengths, standing waves, etc., make the shape of the chamber more important. My application of the Helmholtz resonator is simple or rudimentary; thus complications involved in more sophisticated applications need not be addressed.

Of course the medium filling chamber 14 (gas, liquid or various types of solids), also influences the acoustical effect. In most applications of a Helmholtz resonator, the medium in the cavity is gas, usually air and in my chamber 14 likewise air is most likely to be used. If the medium in a cavity 12 or 14 is a solid, such as a plastic foam, it would need to be of much less density than the metal forming club head 10 in order to achieve a different result than the metal head itself.

The relationship of face plate 16 to first cavity 12 upon impact with a golf ball is like the reaction of a kettledrum to an impact on its membrane. Page 91 and following of the above-cited book by Kinsler and Frey discusses the acoustics of kettledrums. Calculation of frequencies of a kettledrum is a straightforward procedure for acoustical engineers and scientists and, likewise, calculations relating frequencies produced in first cavity 12 upon golf ball impact is a straightforward matter. As before stated, the basic frequency face plate 16 will vibrate is the primary input and may be tested rather than computed and the sound produced in club head 10 modifies this basic frequency according to, basically, kettledrum computations and second cavity 14 modifies the input from cavity 12 according to Helmholtz resonator phenomena computations.

A simple acoustical model can be constructed from FIG. 3 to help explain how my invention works. The model consists of the following elements:

(1) face plate 16

(2) first chamber 12

(3) throat 30

(4) second chamber 14

Each element plays an important role in producing the sound wave emitted by the club head 10 when it strikes the ball.

The fundamental resonance frequency emitted is directly proportional to the thickness of the diaphragm (i.e., face plate 16), when all other physical parameters are held constant. The sizing of the face plate 16, given a particular material, is determined by the mass of the golf ball and the force it will exert on the ball when it is struck by a swinging club. Some of the sound will be reflected, but most will be transmitted into the core of first chamber 12.

First chamber 12 exerts resistive damping forces on the sound wave as it propagates through the medium. As face plate 16 vibrates, the air or other medium in chamber 12 is alternatively compressed and expanded. This action and reaction reduces the energy content of the sound wave. At the same time, it funnels the wave toward the next chamber 14.

The throat 30 is a small opening of radius "a" and length "l" (reference FIG. 4). The gas (i.e., air), in the opening is considered to move as a unit when exited by a sound wave. It provides a mass element for second chamber 14. In addition, another resistance element is provided by the viscous forces associated with the influx and efflux of the gas through opening 30. The second chamber 14 is the body of the Helmholtz resonator. The pressure of the gas within the cavity of the resonator changes as it is alternatively compressed and expanded by the influx and efflux of the gas through the opening 30 and thus provides the stiffness element. The largest portion of the energy contained in the sound wave is attenuated within this chamber 14. Thus the primary sound frequencies emitted by club head 10 is controlled by dimensioning the club to attenuate the desired frequencies.

Having thus described my invention, I do not wish to be understood as limiting myself to the exact details described, but instead wish to cover those modifications thereof that will occur to those skilled in this art upon examining my disclosure and which are properly within the scope of the following claims.

I claim:

1. The improvement in a head of a wood, comprising:

(a) said head having a face and having a first forward chamber opening to said face and a resilient face plate capable of deflecting under impact with a golf ball covering said first chamber and means securing said face plate in place on said head whereby said face plate in striking a golf ball acts like a trampoline that transfers an additional impulse to the golf ball during impact and whereby said face plate acts in respect to said first chamber like the membrane of a kettledrum in producing a sound upon impact with the golf ball that is determined partly by the physical characteristics of said face plate and by the size and shape of said first chamber, and (b) said head having a second rear chamber disposed rearwardly of said first chamber and a throat connecting said second chamber to said first chamber whereby said second chamber and said throat have the function of a Helmholtz resonator modifying said sound propagated in said first chamber upon striking a golf ball.

2. The subject matter of claim 1 in which said first chamber is empty except for gas.

3. The subject matter of claim 1 in which said first chamber is filled with liquid.

4. The subject matter of claim 1 in which said first chamber is filled with a solid of lesser density than the denisty of the material the head is formed from.

5. The subject matter of claim 4 in which said solid has been shaped outside said first chamber and is bonded in place.

6. The subject matter of claim 4 in which said solid has been poured in place in said first chamber as a liquid and then has been solidified in place.

7. The subject matter of claim 1 in which said second chamber is empty except for gas.

8. The subject matter of claim 1 in which said second chamber is filled with liquid.

9. The subject matter of claim 1 in which said second chamber is filled with a solid of lesser density than the density of the material the head is formed from.

10. The subject matter of claim 1 in which said first chamber is half round.

11. The method of adjusting the sound the head of a wood makes upon striking a golf ball, comprising:

(a) providing a first forward chamber in said head and covering said first chamber with a resilient face plate capable of deflecting under impact with a golf ball in the manner of a trampoline and adjusting the physical characteristics of said face plate and the size and shape of said first chamber in the manner of a kettledrum to produce a desired sound in said first chamber upon golf ball impact, and (b) providing a second rear chamber in said head disposed rearwardly of said first chamber and a throat connecting said second chamber to said first chamber and adjusting the sizes of said second chamber and said throat in the manner of adjusting a Helmholtz resonator thereby modifying said sound from said first chamber to produce the desired sound emanating from said head upon impact with a golf ball.

* * * * *